United States Patent [19]

Leib, Jr.

[11] 4,372,600

[45] Feb. 8, 1983

[54] BOTTLE CARRIER

[75] Inventor: Russel W. Leib, Jr., Atlanta, Ga.

[73] Assignee: The Mead Corporation, Dayton, Ohio

[21] Appl. No.: 291,383

[22] Filed: Aug. 10, 1981

Related U.S. Application Data

[63] Continuation of Ser. No. 137,909, Apr. 7, 1980, abandoned.

[51] Int. Cl.[3] ..... B65D 71/00

[52] U.S. Cl. ..... 294/87.2; 206/196

[58] Field of Search ..... 294/87.2, 87.28; 206/140, 148, 151, 190, 193, 196, 435, 427; 229/28 BC, 89, 52 BC

[56] References Cited

U.S. PATENT DOCUMENTS

| | | | |
|---|---|---|---|
| 3,156,377 | 11/1964 | Wysocki | 206/196 |
| 3,387,879 | 6/1968 | Wood | 294/87.2 |
| 3,394,800 | 7/1968 | Brackett et al. | 206/196 |
| 3,897,873 | 8/1975 | Graser | 294/87.2 |

*Primary Examiner*—James B. Marbert

*Attorney, Agent, or Firm*—Rodgers & Rodgers

[57] ABSTRACT

A carrier for use in connection with bottles comprises a bottom wall, a plurality of neck receiving apertures formed in the bottom wall, a pair of upwardly converging composite side walls joined to the side edges of the bottom wall, a plurality of top receiving apertures formed in the side walls and disposed in alignment respectively with the corresponding neck receiving apertures, a side wall extension panel extending generally downwardly from one of the side walls, and a cushioning panel joined to the side wall extension panel and disposed substantially perpendicular thereto.

8 Claims, 5 Drawing Figures

BOTTLE CARRIER

This application is a continuation, of application Ser. No. 137,909, filed Apr. 7, 1980 now abandoned.

TECHNICAL FIELD

This invention relates to bottle carriers of the top gripping variety with adequate cushioning means provided between the packaged bottles.

BACKGROUND ART

Article carriers of the top gripping elongated type especially adapted for use in conjunction with bottles are known in the art as evidenced by U.S. Pat. Nos. 3,387,879; 3,528,697; 3,640,563; 3,860,281 and 4,180,191 all of which are owned by the assignee of this invention. This general category of carrier is extremely economical to produce and is highly reliable as a carrying means for multiple bottles although historically one drawback to carriers of this type has been the lack of adequate and convenient cushioning means between the shoulder portions of the bottles.

DISCLOSURE OF INVENTION

According to this invention, a carrier of elongated configuration is provided and includes a bottom wall with a plurality of neck receiving apertures formed therein, side wall means joined to the bottom wall, a plurality of top receiving apertures formed in the side wall means and disposed in alignment respectively with the corresponding neck receiving apertures, a side wall extension panel joined to the side wall means and extending downwardly therefrom, and a cushioning panel joined to the side wall extension panel and extending inwardly therefrom.

BEST MODE FOR CARRYING OUT THE INVENTION

Figure 1:
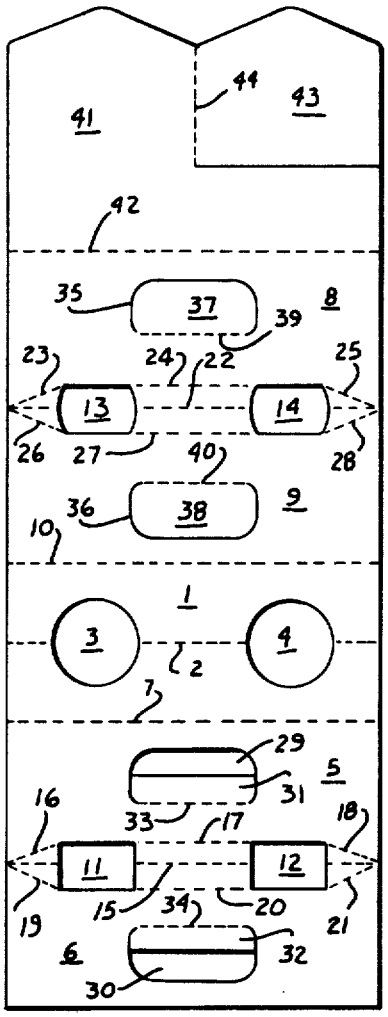
FIG. 1 is a plan view of a blank from which the bottle carrier is formed according to this invention.

In the drawings, the numeral 1 designates the bottom wall of the carrier in which medial fold line 2 and a pair of neck receiving apertures 3 and 4 are formed.

Inner side wall means in the form of inner side wall panels 5 and 6 is joined to a side edge of bottom wall 1 along fold line 7. To the opposite side edge of bottom wall 1, outer side wall means in the form of outer side wall panels 8 and 9 is joined along fold line 10.

In order to receive portions of the packaged bottles, top receiving apertures 11 and 12 are formed in the inner side wall means and, in similar fashion, top receiving apertures 13 and 14 are formed in the outer side wall means.

At one end of the blank, inner side wall panel 6 is foldably joined to inner side wall panel 5 along interrupted fold line 15. Also bend lines 16, 17 and 18 are formed in inner side wall panel 5 and, likewise, bend lines 19, 20 and 21 are formed in inner side wall panel 6. Similar structure is disposed on the opposite side of bottom wall 1 in that outer side wall panel 8 is joined to outer side wall panel 9 along interrupted fold line 22. Additionally, bend lines 23, 24 and 25 are formed in outer side wall panel 8 and bend lines 26, 27 and 28 are formed in outer side wall panel 9.

For the purpose of transporting the carrier, hand gripping apertures 29 and 30 are formed respectively in inner side wall panels 5 and 6. Hand cushioning flaps 31 and 32 are joined respectively to inner side wall panels 5 and 6 along fold lines 33 and 34. In similar fashion, hand gripping apertures 35 and 36 are formed respectively in outer side wall panels 8 and 9 and hand cushioning flaps 37 and 38 are joined respectively thereto along fold lines 39 and 40.

According to a feature of this invention, side wall extension panel 41 is joined to the lower edge of outer side wall panel 8 along fold line 42. Additionally, cushioning panel 43 is joined to side wall extension panel 41 along fold line 44. As is apparent from FIG. 1, fold line 44 is disposed perpendicular to fold line 42 and the length of cushioning panel 43 is approximately one half the length of side wall extension panel 41.

Figure 2:
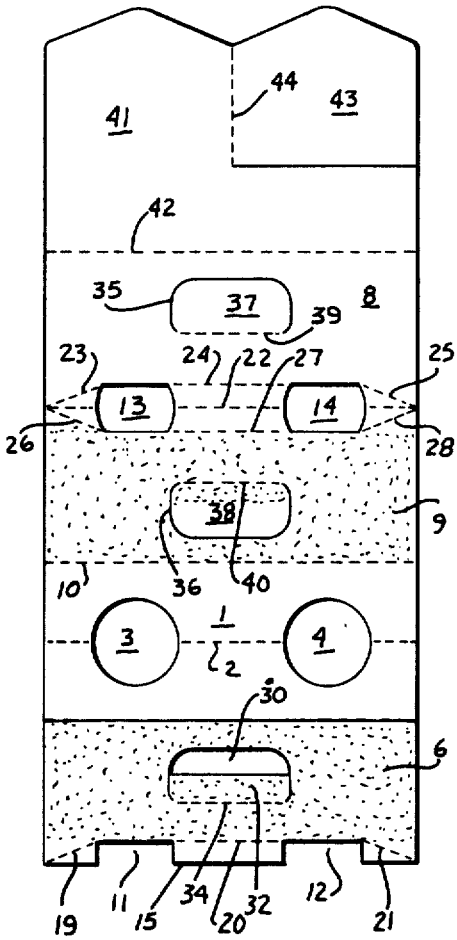
FIGS. 2 and 3 depict intermediate stages through which the blank of FIG. 2 is manipulated and glued in order to form the complete and collapsed carrier as shown in FIG. 4.

In order to form the carrier from the blank shown in FIG. 1, initially it is necessary to fold inner side wall panel 6 upwardly along interrupted fold line 15 into the disposition shown in FIG. 2. Then it is necessary to make an application of glue to inner side wall 6 and outer side wall 9 as shown by stippling in FIG. 2.

Figure 3:
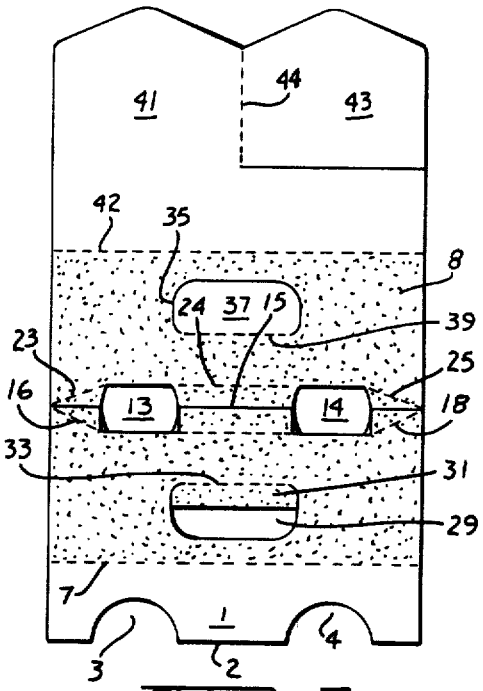

Thereafter the carrier inner side wall means in the form of inner side wall panels 5 and 6 together with one-half of bottom wall 1 are elevated and folded over along fold line 2 to occupy the positions as shown in FIG. 3. By this operation inner side wall panel 6 is adhered to outer side wall panel 9.

Following this operation, an application of glue is made to inner side wall panel 5 and outer side wall panel 8 as shown by stippling in FIG. 3. Following this the inner side wall means together with bottom wall 1 and outer side wall panel 9 are elevated along interrupted fold line 22 and folded over into face contacting glued relation with outer side wall panel 8. The blank then appears as shown in FIG. 4 which represents the carrier in complete and collapsed condition.

Figure 4:
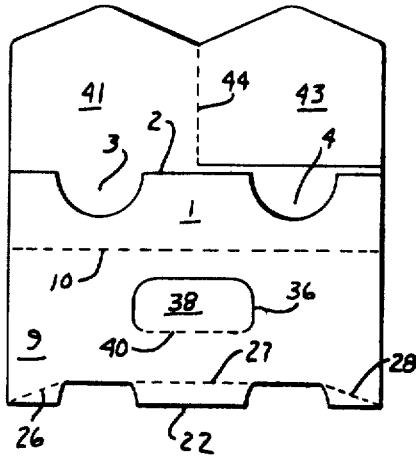
Figure 5:
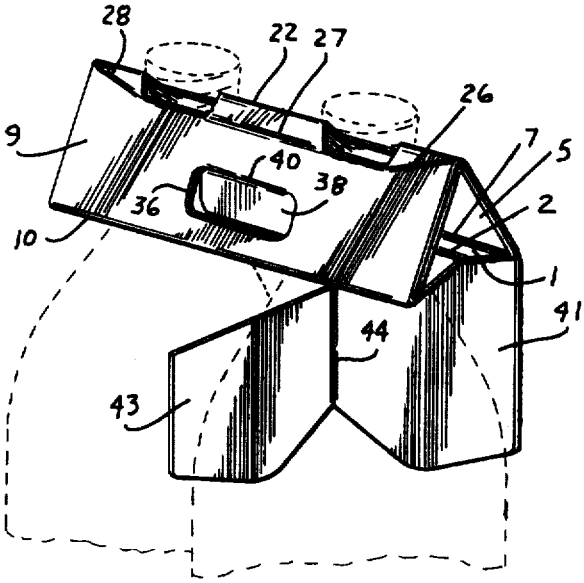
FIG. 5 is an isometric view of the carrier disposed in erected condition.

In order to set up the collapsed carrier as shown in FIG. 4, it is simply necessary to fold bottom wall 1 into a flat plane. By this operation one composite side wall in the form of inner side wall 5 and outer side wall 8 and the other composite side wall in the form of inner side wall 6 and outer side wall 9 assume an upwardly converging relationship from the respective sides of bottom wall 1. As the carrier is formed side wall extension panel 41 automatically extends downwardly from the composite side wall composed of inner side wall panel 6 and outer side wall panel 8. Following this, cushioning panel 43 is simply rotated inwardly along fold line 44 to a position substantially perpendicular to side wall extension panel 41. Then the carrier is simply pressed downwardly into locked relationship with the corresponding bottles to be packaged as is well known. The carrier then appears as shown in FIG. 5 with the cushioning panel 43 disposed between the shoulder portions of adjacent bottles.

While the invention is illustrated and described in connection with a carrier for two bottles in which a single cushioning panel is provided, it is apparent that a top gripping carrier for more than two bottles would lude a plurality of cushioning panels so as to afford a ;hioning between each pair of adjacent bottles in a ɴ of bottles.

INDUSTRIAL APPLICABILITY

By this invention an economical top gripping carrier provided for the packaging of bottles which includes 'ective and convenient separation and cushioning ;ans between the shoulder portions of the bottles.

I claim:

1. A bottle carrier comprising a bottom wall having a urality of neck receiving apertures, a pair of side walls ined respectively along their bottom edges to the side lges of said bottom wall, each of said side walls being rmed of inner and outer panels secured together in ce contacting relation, a plurality of top receiving ›ertures formed in the upper portions of said side walls ıd disposed respectively in aligned relationship with ıid neck receiving apertures, a side wall extension anel foldably joined to one of said outer panels and ɪtending generally downwardly therefrom and disosed in an overlying relationship with the shoulder ortion of at least one bottle, and a cushioning panel ›ined to said side wall extension panel and extending enerally laterally inwardly therefrom.

2. A bottle carrier according to claim 1 wherein said ushioning panel is joined to said side wall extension panel along a fold line disposed substantially perpendicular to the junction between said side wall extension panel and said outer panel.

3. A bottle carrier according to claim 1 wherein said cushioning panel is disposed generally perpendicular to said side wall extension panel.

4. A bottle carrier according to claim 1 wherein a medial fold line is formed in said bottom wall.

5. A bottle carrier according to claim 1 wherein a pair of hand gripping apertures are formed respectively in said pair of side walls.

6. A bottle carrier blank comprising a bottom wall, inner side wall means foldably joined to a side edge of said bottom wall, outer side wall means foldably joined to the opposite side edge of said bottom wall, a side wall extension panel foldably joined to said outer side wall means remote from said bottom wall, and a cushioning panel foldably joined to said side wall extension panel along a fold line disposed generally perpendicular to the fold line between said side wall extension panel and said outer side wall means.

7. A bottle carrier blank according to claim 6 wherein the length of said cushioning panel is approximately one half the length of said side wall extension panel.

8. A bottle carrier blank according to claim 6 wherein a medial fold line is formed in said bottom wall.

* * * * *